US009968181B2

(12) United States Patent
Nomura-Rodgers

(10) Patent No.: US 9,968,181 B2
(45) Date of Patent: May 15, 2018

(54) CLEANING SYSTEM

(71) Applicant: Lisa Nomura-Rodgers, South Pasadena, CA (US)

(72) Inventor: Lisa Nomura-Rodgers, South Pasadena, CA (US)

( * ) Notice: Subject to any disclaimer, the term of this patent is extended or adjusted under 35 U.S.C. 154(b) by 0 days. days.

(21) Appl. No.: 15/389,264

(22) Filed: Dec. 22, 2016

(65) Prior Publication Data

US 2017/0181533 A1 Jun. 29, 2017

Related U.S. Application Data

(60) Provisional application No. 62/272,584, filed on Dec. 29, 2015.

(51) Int. Cl.

| | |
|---|---|
| ***A46B 5/04*** | (2006.01) |
| ***A46B 5/00*** | (2006.01) |
| ***B08B 1/00*** | (2006.01) |

(52) U.S. Cl.

CPC ..... *A46B 5/0016* (2013.01); *A46B 5/04* (2013.01); *B08B 1/002* (2013.01)

(58) Field of Classification Search

CPC ..... A46B 3/00; A46B 5/0008; A46B 5/0012; A46B 5/02; A46B 5/04; A46B 7/04; A46B 2200/3033; A47L 13/10; A47L 13/12; A47L 13/18; A47L 13/46; B24D 15/02; B24D 15/045

See application file for complete search history.

(56) References Cited

U.S. PATENT DOCUMENTS

| | | | | |
|---|---|---|---|---|
| 3,966,335 | A | 6/1976 | Abramson | |
| 5,815,876 | A | 10/1998 | Overseth | |
| 6,481,443 | B1 | 11/2002 | Moore-Johnson et al. | |
| 7,008,132 | B1 | 3/2006 | Phua et al. | |
| 2006/0200926 | A1* | 9/2006 | Graham | A47L 25/08 15/188 |
| 2006/0272116 | A1* | 12/2006 | Thompson | A47L 13/18 15/227 |

* cited by examiner

*Primary Examiner* — Shay Karls
(74) *Attorney, Agent, or Firm* — Plager Schack LLP; Mark H. Plager

(57) ABSTRACT

A cleaning system is adapted to clean a surface and includes a first side, a second side, a third side and a fourth side. Bristles are formed within the second side. Bumps are formed within the first side. Finger holes are formed between the first side and the second side at the third side. An opening is formed between the first side and the second side at the fourth side. In one embodiment, fingers are inserted into the finger holes, enabling a user to clean the surface with two different textures with the housing over the user's fingers. This enables fingertip control on either the brush side or the bump side. In one embodiment, fingers are inserted into the slotted side to enable a user to clean the surface with two different textures with the housing in the palm of the user's hand. This enables greater pressure onto the surface.

5 Claims, 4 Drawing Sheets

FIG.1
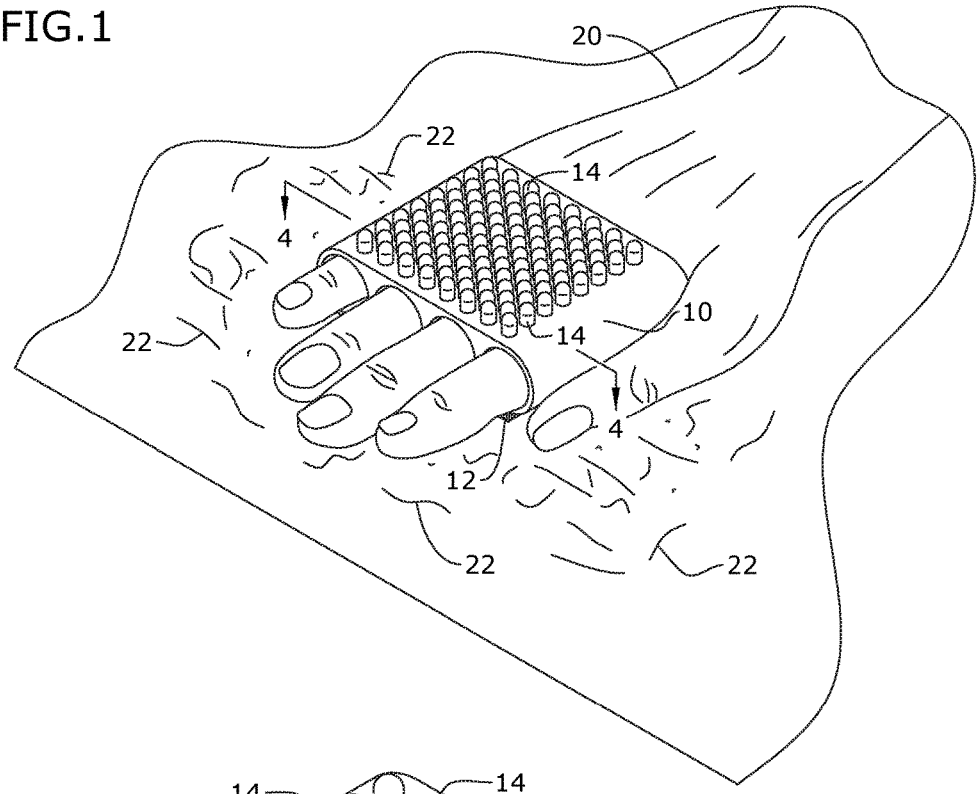
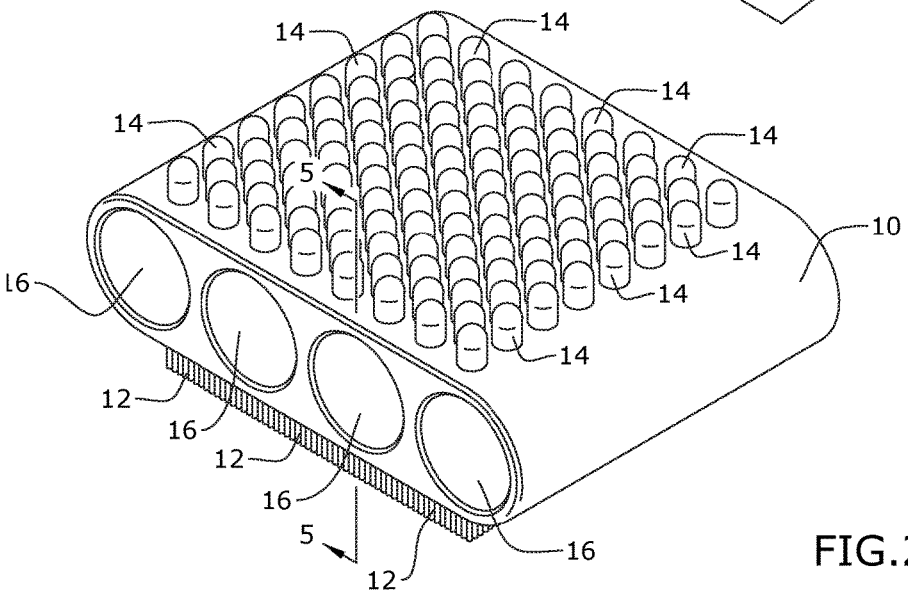
FIG.2

FIG.3
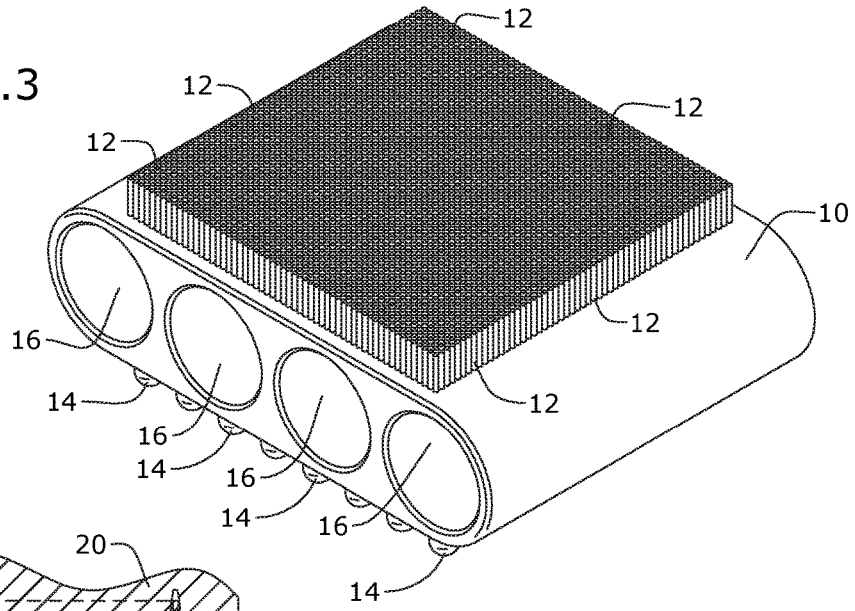
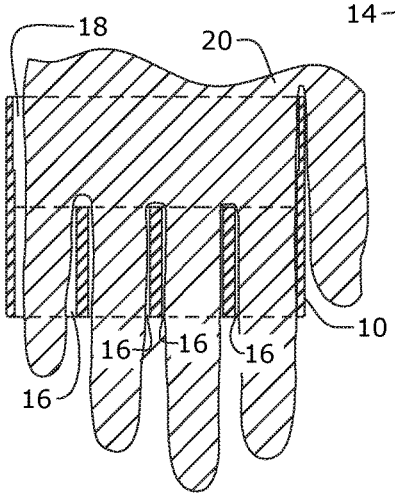
FIG.4
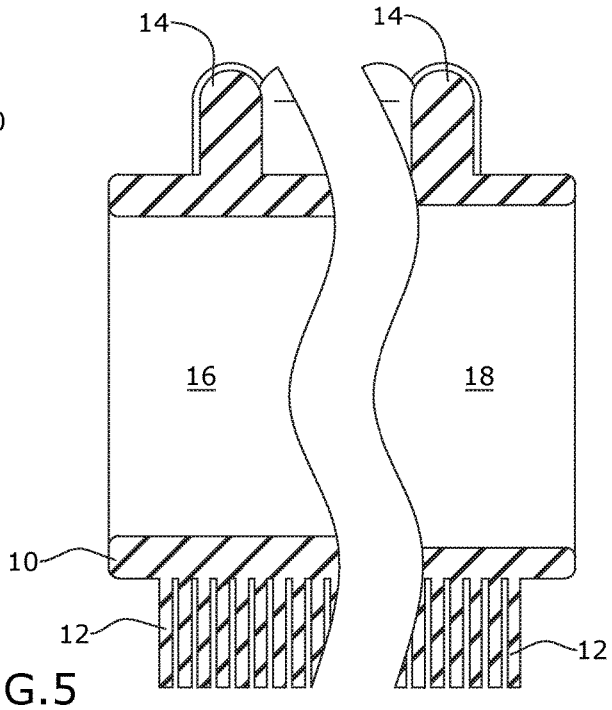
FIG.5

FIG.6
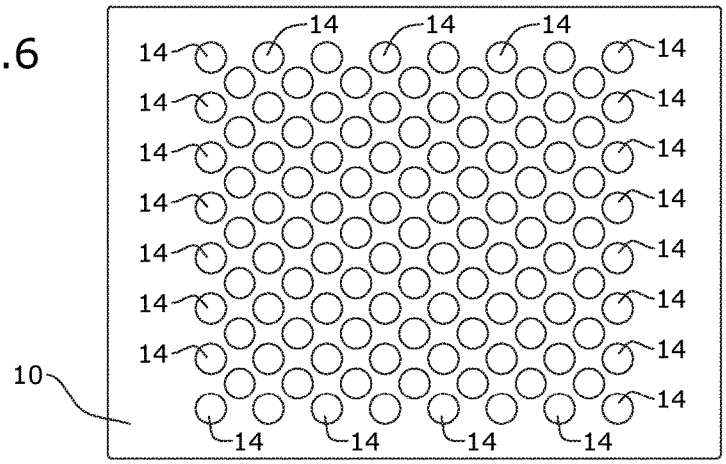
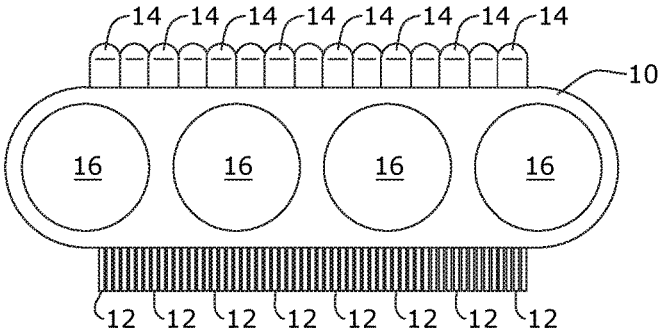
FIG.7
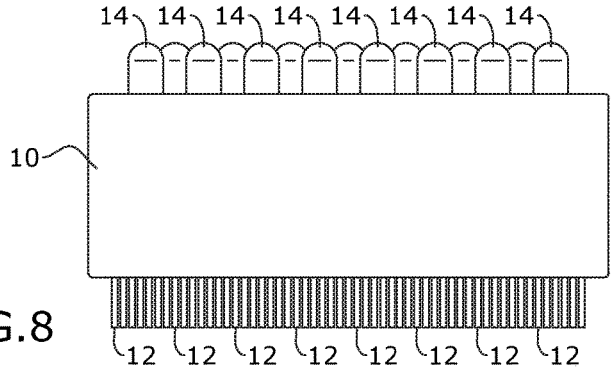
FIG.8

CLEANING SYSTEM

RELATED APPLICATION

This application claims priority to provisional patent application U.S. Ser. No. 62/272,584 filed on Dec. 29, 2015, the entire contents of which is herein incorporated by reference.

BACKGROUND

The embodiments herein relate generally to systems that can be used for cleaning surfaces. Prior to embodiments of the disclosed invention, many surfaces are difficult to clean, especially because foreign substances become dried and stuck to these surfaces. Embodiments of the disclosed invention solve this problem.

SUMMARY

A cleaning system is adapted to clean a surface. The cleaning system has a housing further comprising a first side, a second side, a third side and a fourth side. Bristles are formed within the second side. Bumps are formed within the first side. Finger holes are formed between the first side and the second side at the third side. An opening is formed between the first side and the second side at the fourth side. In one embodiment, fingers are inserted into the finger holes, enabling a user to clean the surface with two different textures with the housing over the user's fingers. This enables fingertip control on either the brush side or the bump side. In one embodiment, fingers are inserted into the slotted side to enable a user to clean the surface with two different textures with the housing in the palm of the user's hand. This enables greater pressure onto the surface.

BRIEF DESCRIPTION OF THE FIGURES

The detailed description of some embodiments of the invention is made below with reference to the accompanying figures, wherein like numerals represent corresponding parts of the figures.

FIG. 1 shows a perspective view of one embodiment of the present invention;

FIG. 2 shows a top perspective view of one embodiment of the present invention;

FIG. 3 shows a bottom perspective view of one embodiment of the present invention;

FIG. 4 shows a section view of one embodiment of the present invention taken from 4-5 in FIG. 1;

FIG. 5 shows a section view of one embodiment of the present invention taken from 5-5 in FIG. 2;

FIG. 6 shows a top view of one embodiment of the present invention;

FIG. 7 shows a front view of one embodiment of the present invention;

FIG. 8 shows a side view of one embodiment of the present invention;

DETAILED DESCRIPTION OF CERTAIN EMBODIMENTS

Figure 9:
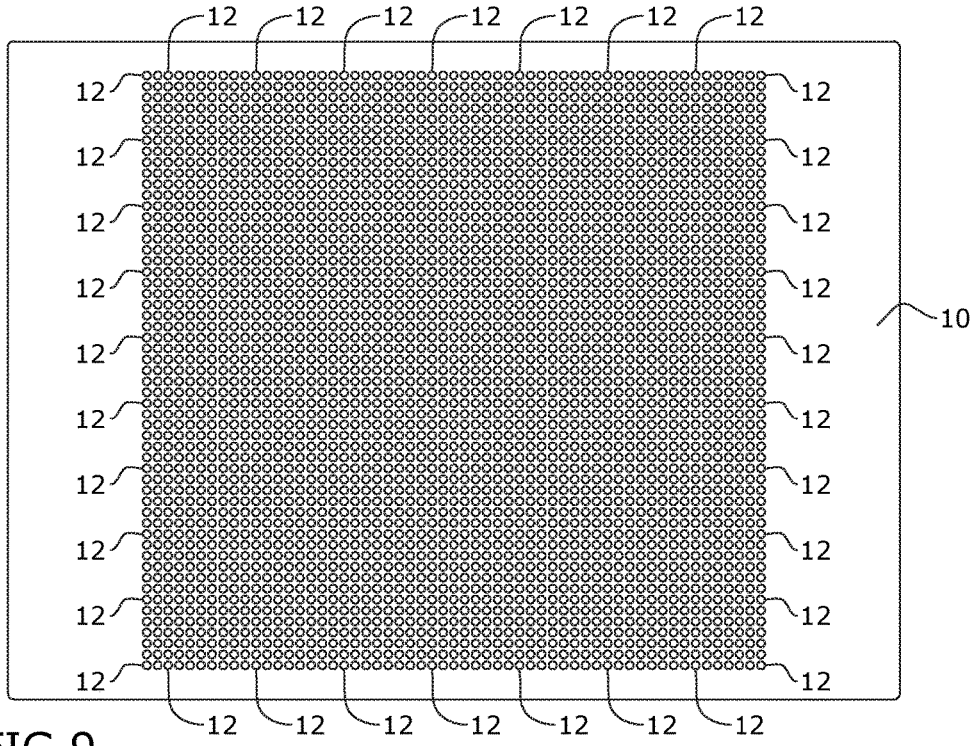
FIG. 9 shows a bottom view of one embodiment of the present invention.
Figure 10:
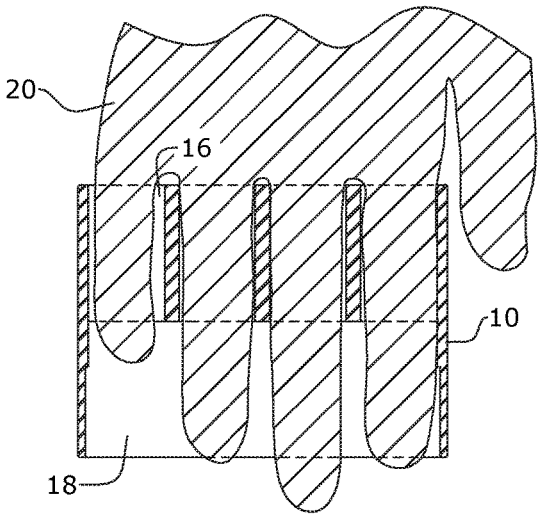
FIG. 10 shows a section view of one embodiment of the present invention.

By way of example, and referring to FIGS. 1-10, one embodiment of a cleaning system comprises housing 10.

Housing 10 further comprises a first side, a second side, a third side and a fourth side. The second side is formed to connect with bristles 12. The first side is formed to connect with bumps 14. Between the first side and the second side at the third side are finger holes 16, which are adapted to accommodate the fingers of a human user 20 on a tubular side. Between the first side and the second side at the fourth side is slotted 18 on a slotted side. To use the device, the user slides fingers into finger holes 16 and then bumps a surface to clean debris 22.

In some embodiments, housing 10, bristles 12 and bumps 14 can be molded from a single unit of silicone or a similar material. Bristles 12 and bumps 14 are provided as exemplary expels of two items with different textures, but many other items may be used as well. In some embodiments finger holes 12 are arranged to from tubular openings, but other shapes can also be used. In some embodiments, four internal tubular structures for the insertion of ones four fingers excluding the thumb. The cleaning system is reversible, as either the first side or the second side can be facing the palm or back of the hand of human user 20.

There are multiple positions that housing 10 can be placed relative to a hand 20. In a first mode of operation, hand 20 enters palm up through opening 18 housing 10 fits over knuckles of user 20 such that bristles 12 are upward and bumps 14 are downward. In a second mode of operation, hand 20 enters palm down through opening 18 housing 10 fits over knuckles of user 20 such that bristles 12 are downward and bumps 14 are upward as shown in FIG. 1. In a third mode of operation, hand 20 enters palm up through finger holes 16 such that housing 10 stops at the webbing area of the fingers of hand 20 and bristles 12 are downward and bumps 14 are upward. In a fourth mode of operation, hand 20 enters palm down through finger holes 16 such that housing 10 stops at the webbing area of the fingers of hand 20 and bristles 12 are upward and bumps 14 are downward.

In some embodiments, the length of the bristles 12 and bumps 14 can vary. The bristles 12 and bumps 14 can be staggered or aligned. There need not be four finger holes 16, in some embodiments, there can be two. Housing 10 can be made of many materials, but 100% silicone that is antibacterial, heat resistant, hydrophobic makes housing 10 it easy to clean.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection.

The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations that may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A cleaning system, adapted to clean a surface, the cleaning system comprising:

a housing further comprising a first side, a second side, a third side and a fourth side; wherein the first side is parallel to the second side and the first side is perpendicular to the third side and the fourth side; wherein the first side and the second side are directly joined to the third side and the fourth side;

a plurality of bristles, formed within the second side and having a first texture;

a plurality of bumps, formed within the first side and having a second texture;

a plurality of finger holes, formed with a plurality of material barriers between and adjacent to the first side and the second side at the third side while being distant from the fourth side forming a plurality of slots at the third side extending toward the fourth side;

an opening, formed between the first side and the second side at the fourth side;

wherein fingers, inserted into the finger holes, enable a user to clean the surface with two different textures.

2. The cleaning system of claim 1, wherein the plurality of bristles is arranged into a plurality of aligned bristle rows and aligned bristle columns.

3. The cleaning system of claim 2, wherein the plurality of bumps is arranged into a plurality of staggered bump rows and staggered bump columns.

4. The cleaning system of claim 1, wherein the plurality of finger holes is at least two finger holes.

5. The cleaning system of claim 1, wherein the plurality of finger holes is at least four finger holes.

* * * * *